US009874196B2

(12) United States Patent
Chauhan et al.

(10) Patent No.: US 9,874,196 B2
(45) Date of Patent: Jan. 23, 2018

(54) DOUBLE PADDLE MECHANISM FOR POOL CLEANER

(71) Applicants: Pawan Kumar Chauhan, Haryana (IN); Narendra Pratap Singh, Uttar Pradesh (IN)

(72) Inventors: Pawan Kumar Chauhan, Haryana (IN); Narendra Pratap Singh, Uttar Pradesh (IN)

(73) Assignee: Pentair Water Pool and Spa, Inc., Cary, NC (US)

( * ) Notice: Subject to any disclaimer, the term of this patent is extended or adjusted under 35 U.S.C. 154(b) by 723 days.

(21) Appl. No.: 14/209,789

(22) Filed: Mar. 13, 2014

(65) Prior Publication Data

US 2014/0271124 A1 Sep. 18, 2014

Related U.S. Application Data

(60) Provisional application No. 61/780,558, filed on Mar. 13, 2013.

(51) Int. Cl.
*F03B 3/12* (2006.01)
*E04H 4/16* (2006.01)
(Continued)

(52) U.S. Cl.
CPC ..... *F03B 3/12* (2013.01); *E04H 4/1636* (2013.01); *F03B 13/00* (2013.01); *F05B 2220/20* (2013.01)

(58) Field of Classification Search
CPC ... E04H 4/1636; E04H 4/1645; E04H 4/1654; E04H 4/1672; F04D 29/424; F04D 29/426; F04D 29/4293
(Continued)

(56) References Cited

U.S. PATENT DOCUMENTS 1,200,308 A 10/1916 Bunnell
1,902,728 A 3/1933 Schmidt
(Continued)

FOREIGN PATENT DOCUMENTS

AU 7241881 A 1/1982
AU 732645 B2 4/2001
(Continued)

OTHER PUBLICATIONS

Zodiac Pool Systems. Inc.; Polaris 3900 Owner's Manual; pp. 1-12; 2008; Vista, CA 92081-8438.
(Continued)

*Primary Examiner* — Nathaniel Wiehe
*Assistant Examiner* — Brian O Peters
(74) *Attorney, Agent, or Firm* — Quarles & Brady LLP

(57) ABSTRACT

Embodiments of the invention provide a paddle wheel mechanism for a pool cleaner. The paddle wheel mechanism includes a housing, a paddle wheel shaft supported by the housing, a first paddle wheel, and a second paddle wheel. The housing directs fluid from a fluid path of the pool cleaner into a first flow path and a second flow path. The first paddle wheel is supported by the paddle wheel shaft and is positioned within the housing along the first flow path. The second paddle wheel is supported by the paddle wheel shaft and is positioned within the housing along the second flow path. The first paddle wheel rotates responsive to fluid directed along the first flow path, and the second paddle wheel rotates responsive to fluid directed along the second flow path.

17 Claims, 5 Drawing Sheets

(51) Int. Cl.
*F03B 13/10* (2006.01)
*F04D 29/42* (2006.01)
*F03B 13/00* (2006.01)

(58) Field of Classification Search
USPC ..... 415/53.199, 101, 102, 116, 203, 204; 416/175, 198 R, 200 R, 201 A, 203
See application file for complete search history.

(56) References Cited

U.S. PATENT DOCUMENTS 2,141,811 A 12/1938 Everson
2,191,424 A 2/1940 Cardinal
2,646,889 A 7/1953 Dulak
2,832,561 A 4/1958 Holl
2,988,762 A 6/1961 Babcock
3,301,606 A 1/1967 Bruno
3,321,787 A 5/1967 Myers
3,324,492 A 6/1967 Myers
3,405,733 A 10/1968 Hansen
3,439,368 A 4/1969 Myers
3,444,575 A 5/1969 Martin
RE26,741 E 12/1969 Myers
3,551,930 A 1/1971 Myers
3,556,151 A 1/1971 Masuda
3,790,979 A 2/1974 Foster
3,857,651 A 12/1974 Bruno
3,860,518 A 1/1975 Henricksen
3,921,654 A 11/1975 Pansini
3,936,899 A 2/1976 Henkin et al.
3,950,809 A 4/1976 Schatzmann
3,959,838 A 6/1976 Hannah
3,961,393 A 6/1976 Pansini
3,979,788 A 9/1976 Strausak
4,007,749 A 2/1977 Pansini
4,007,996 A 2/1977 Boone
4,077,424 A 3/1978 Ehret et al.
4,086,933 A 5/1978 Pansini
4,177,009 A 12/1979 Baum et al.
4,313,455 A 2/1982 Pitman
4,356,582 A 11/1982 Stephenson
4,402,101 A 9/1983 van Zyl
4,429,429 A 2/1984 Altschul
4,458,708 A 7/1984 Leonard et al.
4,501,297 A 2/1985 Baker
4,522,221 A 6/1985 Chivens et al.
4,536,908 A 8/1985 Raubenheimer
4,558,479 A 12/1985 Greskovics et al.
4,589,986 A 5/1986 Greskovics et al.
4,718,613 A 1/1988 Moomaw
4,722,110 A 2/1988 Chandler
4,766,931 A 8/1988 Chauvier et al.
4,789,364 A 12/1988 Chauvier et al.
4,817,656 A 4/1989 Gould
4,835,810 A 6/1989 Hugo
4,950,393 A 8/1990 Goettl
5,001,800 A 3/1991 Parenti et al.
5,002,461 A 3/1991 Young et al.
5,014,912 A 5/1991 Brooks
5,044,034 A 9/1991 Iannucci
5,048,149 A 9/1991 Heinen, Jr.
5,082,022 A 1/1992 Boundy
5,093,950 A 3/1992 Heier
5,105,496 A 4/1992 Gray et al.
5,259,082 A 11/1993 Sebor
5,259,258 A 11/1993 Sebor
5,261,287 A 11/1993 Sebor
5,274,868 A 1/1994 Sebor
5,285,547 A 2/1994 Sebor
5,303,444 A 4/1994 Sebor
5,371,910 A 12/1994 Sebor
5,386,607 A 2/1995 Sebor
5,404,607 A 4/1995 Sebor
5,412,826 A 5/1995 Raubenheimer
5,435,031 A 7/1995 Minami et al.
5,507,058 A 4/1996 Minami et al.
D373,230 S 8/1996 Sebor et al.
5,584,656 A 12/1996 Rose
5,603,135 A 2/1997 Jones et al.
5,603,831 A * 2/1997 Hickok ..... A01K 63/047 119/260
5,617,600 A 4/1997 Frattini
5,664,275 A 9/1997 Sebor
5,740,576 A 4/1998 Sebor et al.
5,771,987 A 6/1998 Marbach
5,788,850 A 8/1998 Tuomey
5,797,156 A 8/1998 Sebor
D401,023 S 11/1998 Sebor et al.
5,863,425 A 1/1999 Herlehy et al.
5,893,188 A 4/1999 Campbell et al.
5,896,610 A 4/1999 Sebor et al.
D409,341 S 5/1999 Van Etten et al.
5,933,899 A 8/1999 Campbell et al.
D417,047 S 11/1999 Tsuda
5,974,647 A 11/1999 Sebor
5,985,156 A 11/1999 Henkin et al.
5,988,600 A * 11/1999 Vento ..... B01F 3/04531 261/121.2
6,003,184 A 12/1999 Campbell et al.
D418,640 S 1/2000 Veloskey et al.
6,039,886 A 3/2000 Henkin et al.
6,061,860 A 5/2000 Fitzgerald
6,094,764 A 8/2000 Veloskey et al.
6,115,864 A 9/2000 Davidsson et al.
6,119,293 A 9/2000 Phillipson et al.
6,158,464 A 12/2000 Campbell et al.
6,189,556 B1 2/2001 Blake et al.
6,212,725 B1 4/2001 Porat
6,237,175 B1 5/2001 Phillipson et al.
D444,280 S 6/2001 Rief et al.
6,280,611 B1 8/2001 Henkin et al.
6,292,970 B1 9/2001 Rief et al.
6,299,699 B1 10/2001 Porat et al.
6,311,353 B1 11/2001 Phillipson et al.
6,311,728 B1 11/2001 Goettl et al.
6,325,087 B1 12/2001 Tarr
6,365,039 B1 4/2002 Henkin et al.
6,387,250 B1 5/2002 Henkin et al.
6,398,878 B1 6/2002 Henkin et al.
6,412,133 B1 7/2002 Erlich et al.
D468,067 S 12/2002 Stoltz et al.
D469,589 S 1/2003 Wichmann et al.
6,502,269 B1 1/2003 Balchan et al.
6,539,967 B2 4/2003 Tarr
6,560,808 B2 5/2003 Phillipson et al.
6,564,417 B2 5/2003 Porat
6,601,255 B1 8/2003 Van der Meyden et al.
D481,181 S 10/2003 Lath et al.
6,652,742 B2 11/2003 Henkin et al.
6,665,900 B2 12/2003 Wichmann et al.
RE38,479 E 3/2004 Henkin et al.
6,740,233 B2 5/2004 Stoltz et al.
6,782,578 B1 8/2004 Rief et al.
6,854,148 B1 2/2005 Rief et al.
6,908,550 B2 6/2005 Silverstein
6,932,112 B2 8/2005 Bradford, III et al.
6,965,814 B2 11/2005 Hadari
6,971,136 B2 12/2005 Horvath et al.
6,984,315 B2 1/2006 Dolton, III
7,039,980 B2 5/2006 Van Der Meyden et al.
D526,101 S 8/2006 Tailleur
D529,669 S 10/2006 Blanc-Tailleur
7,117,554 B2 10/2006 Pichon
7,162,763 B2 1/2007 Henkin et al.
7,168,120 B2 1/2007 Habif et al.
7,201,563 B2 4/2007 Studebaker
7,213,287 B2 5/2007 Hui
7,243,389 B2 7/2007 Phillipson
7,293,314 B2 11/2007 Henkin et al.
7,316,751 B2 1/2008 Horvath et al.
7,318,448 B2 1/2008 Fleischer et al.
7,373,948 B2 5/2008 Campbell et al.
D575,915 S 8/2008 Dreyer
D581,611 S 11/2008 Van der Meijden et al.

(56) References Cited

U.S. PATENT DOCUMENTS

| | | | |
|---|---|---|---|
| D582,112 | S | 12/2008 | Van der Meijden et al. |
| 7,464,429 | B2 | 12/2008 | Stoltz |
| D584,209 | S | 1/2009 | Klimas |
| 7,520,282 | B2 | 4/2009 | Stoltz |
| D594,610 | S | 6/2009 | Klimas |
| D598,168 | S | 8/2009 | Sumonthee |
| D599,967 | S | 9/2009 | Blanc-Tailleur |
| 7,621,014 | B2 | 11/2009 | Katz |
| 7,677,268 | B2 | 3/2010 | Griffin et al. |
| 7,690,066 | B2 | 4/2010 | Stoltz et al. |
| 7,723,934 | B2 | 5/2010 | Adam et al. |
| 7,726,342 | B2 | 6/2010 | Campbell et al. |
| 7,736,523 | B2 | 6/2010 | King |
| 7,765,639 | B2 | 8/2010 | Lee et al. |
| 7,805,792 | B2 | 10/2010 | Roumagnac |
| 7,827,643 | B2 | 11/2010 | Erlich et al. |
| 7,849,547 | B2 | 12/2010 | Erlich et al. |
| 7,849,558 | B2 | 12/2010 | Ivarsson et al. |
| 7,900,308 | B2 | 3/2011 | Erlich et al. |
| 8,117,704 | B2 | 2/2012 | Schneider et al. |
| 8,141,191 | B2 | 3/2012 | Hui |
| 8,266,752 | B2 | 9/2012 | Henkin et al. |
| D670,459 | S | 11/2012 | Mastio et al. |
| D670,460 | S | 11/2012 | Mastio et al. |
| D670,461 | S | 11/2012 | Mastio et al. |
| D670,462 | S | 11/2012 | Mastio et al. |
| D670,463 | S | 11/2012 | Mastio et al. |
| D670,464 | S | 11/2012 | Mastio et al. |
| D670,465 | S | 11/2012 | Mastio et al. |
| 8,307,485 | B2 | 11/2012 | Sumonthee |
| 8,341,789 | B2 | 1/2013 | Garti |
| 8,397,330 | B2 | 3/2013 | Pichon et al. |
| 8,402,585 | B2 | 3/2013 | Rief et al. |
| 8,402,586 | B2 | 3/2013 | Lavabre |
| 8,424,142 | B2 | 4/2013 | Garti |
| D684,738 | S | 6/2013 | Richiuso et al. |
| 8,505,143 | B2 | 8/2013 | Finezilber |
| 8,510,889 | B2 | 8/2013 | Hui et al. |
| 8,595,880 | B2 | 12/2013 | Pichon et al. |
| 8,752,226 | B2 | 6/2014 | Erlich et al. |
| 9,062,473 | B2 | 6/2015 | Erlich |
| 9,133,639 | B2 | 9/2015 | Ben-Dov et al. |
| 2004/0265122 | A1* | 12/2004 | Bresolin ..... F04D 15/0077 415/203 |
| 2005/0108836 | A1 | 5/2005 | Rowan et al. |
| 2005/0126969 | A1 | 6/2005 | Dolton |
| 2005/0262652 | A1 | 12/2005 | Sumonthee |
| 2007/0294846 | A1 | 12/2007 | Lapping |
| 2008/0087299 | A1 | 4/2008 | Erlich et al. |
| 2008/0125943 | A1 | 5/2008 | Finezilber |
| 2008/0128343 | A1 | 6/2008 | Garti |
| 2008/0235887 | A1 | 10/2008 | Horvath et al. |
| 2008/0236628 | A1 | 10/2008 | Horvath et al. |
| 2008/0244843 | A1 | 10/2008 | Hui et al. |
| 2009/0211641 | A1 | 8/2009 | Tipotsch |
| 2009/0300862 | A1 | 12/2009 | Schneider et al. |
| 2009/0307854 | A1 | 12/2009 | Garti |
| 2010/0065482 | A1 | 3/2010 | Sumonthee |
| 2010/0119358 | A1 | 5/2010 | Van Der Meijden et al. |
| 2010/0299852 | A1 | 12/2010 | Fayyad |
| 2010/0299863 | A1 | 12/2010 | Dewing |
| 2011/0000030 | A1 | 1/2011 | Pichon et al. |
| 2011/0154585 | A1 | 6/2011 | Mastio et al. |
| 2011/0162683 | A1 | 7/2011 | Mastio et al. |
| 2011/0301752 | A1 | 12/2011 | Finezilber |
| 2012/0060307 | A1 | 3/2012 | Stoltz |
| 2012/0144605 | A1 | 6/2012 | Dewings |
| 2012/0174326 | A1 | 7/2012 | Finezilber |
| 2012/0210527 | A1 | 8/2012 | Erlich et al. |
| 2012/0285486 | A1 | 11/2012 | Erlich et al. |
| 2013/0081216 | A1 | 4/2013 | Gopalan et al. |
| 2013/0091641 | A1 | 4/2013 | Ben Zion |
| 2013/0133145 | A1 | 5/2013 | Pichon et al. |
| 2013/0152316 | A1 | 6/2013 | Rief et al. |
| 2014/0096329 | A1 | 4/2014 | Garti et al. |
| 2014/0230168 | A1 | 8/2014 | Dov et al. |
| 2014/0259465 | A1 | 9/2014 | Van der Meijden |
| 2014/0262997 | A1 | 9/2014 | Renaud et al. |

FOREIGN PATENT DOCUMENTS

| | | | |
|---|---|---|---|
| EP | 0239498 | A2 | 9/1987 |
| EP | 1978184 | A2 | 10/2008 |
| ES | 2374887 | A | 2/2012 |
| GB | 2312711 | A | 11/1997 |
| MX | 2009000336 | A | 7/2010 |
| WO | 9002265 | A1 | 3/1990 |
| WO | 2009111806 | A1 | 9/2009 |
| WO | 2011100067 | A1 | 8/2011 |

OTHER PUBLICATIONS

Waterco; Nitro Robotic Wall Scrubber Cleaner; pp. 1-2; Rydalmere, Australia.

* cited by examiner

DOUBLE PADDLE MECHANISM FOR POOL CLEANER

CROSS REFERENCE TO RELATED APPLICATIONS

This application claims the benefit of U.S. Provisional Patent Application No. 61/780,558 filed on Mar. 13, 2013, the entire contents of which are incorporated herein by reference.

BACKGROUND

Mechanical pool cleaners are typically classified as pressure-side cleaners or suction-side cleaners based on their connection to a pool pump. More specifically, suction-side pool cleaners are connected to a suction or inlet port of the pump, while pressure-side pool cleaners are connected to a pressure or outlet port of the pump. In both types, water is drawn or forced through the cleaner and mechanisms are provided to attempt to harvest energy from water movement through the cleaner in order to operate one or more functions of the cleaner (e.g., vacuuming, steering, etc.).

With respect to suction-side pool cleaners, a turbine or paddle wheel may be provided within a water flow passage to harvest energy from the water flow. Generally, design aspects of the paddle wheel and related components are based on a tradeoff between performance and efficiency. For example, reducing the clearances between blades of the paddle wheel and the walls of the associated flow passage may increase efficiency by allowing the paddle wheel to harness more kinetic energy from the fluid flow. However, reduced clearance may detrimentally affect paddle wheel performance because debris may not be allowed to pass through the water flow passage, and/or may impede rotation of the paddle wheel. On the other hand, increasing the clearances may improve performance by allowing debris to pass through the passage without impeding the paddle wheel. In this instance, however, more fluid may flow through the larger clearances without providing kinetic energy to the paddle wheel, which may result in reduced efficiency.

One pool cleaning system includes a pool cleaner with a primary turbine and two secondary turbines. The primary turbine is mounted to a primary shaft and is fed by a primary fluid inlet. Fluid flow from the primary fluid inlet causes the primary turbine to rotate, thereby causing movement of the pool cleaner via walking pods. The secondary turbines are separately mounted to secondary shafts that are distinct from the primary shaft, and are fed by a secondary fluid inlet. Fluid flow from the secondary fluid inlet causes the secondary turbines to rotate in order to provide torque to a suction hose. Among other drawbacks, the use of separate turbines on separate shafts may not appropriately address the handling of debris to optimize performance and efficiency.

Another pool cleaning system includes a first turbine receiving fluid flow from an external flow generator to drive rotation of a drive shaft. Rotation of the drive shaft drives rotation of a second turbine, which acts as an internal flow generator to expel water from the system.

A further pool cleaning system includes two distinct vortex chambers for generating a swirling pattern of fluid flow within the chambers. Two turbines of the same type (i.e., of the same shape and size) are provided, with one turbine being oriented in each chamber at a location that is removed from the direct flow of fluid through the chamber. Fluid flow from an inlet is equally divided between the two chambers, with the swirling flow pattern within the chambers driving rotation of the turbines. The turbines are supported by independent shafts, with one of the turbines providing motive power to a first drive wheel of the system and the other turbine providing motive power to a second drive wheel of the system. Among other drawbacks, removal of turbines from the direct flow path of a fluid flow may result in reduced system efficiency. Further, the use of two turbines of the same type may not assist in the handling of debris to optimize performance and efficiency.

SUMMARY

Some embodiments provide a paddle wheel mechanism for a pool cleaner. The paddle wheel mechanism includes a housing, a first paddle wheel, and a second paddle wheel. The first and second paddle wheels are both positioned within the housing and are both supported by a single paddle wheel shaft. The first paddle wheel rotates in response to fluid from a first flow path, and the second paddle wheel rotates in response to fluid from a second flow path.

Other embodiments provide a pool cleaner with a housing and a paddle wheel shaft supported by the housing. A first paddle wheel and a second paddle wheel are both positioned within the housing and are both supported by the paddle wheel shaft. The first paddle wheel rotates in response to fluid from a first flow path. The second paddle wheel is defined by a different geometry than the first paddle wheel and rotates in response to fluid from a second flow path.

Still other embodiments provide a paddle wheel mechanism for a pool cleaner, the paddle wheel mechanism including a paddle wheel shaft, a first paddle wheel, a second paddle wheel, and a housing with first and second paddle wheel compartments. The housing is configured to direct fluid from a fluid path into a first flow path through the first paddle wheel compartment and a second flow path through the second paddle wheel compartment. The first paddle wheel is supported by the paddle wheel shaft within the first paddle wheel compartment, includes a first plurality of paddle wheel blades with distal tips, and rotates in response to fluid from the first flow path. The second paddle wheel is supported by the paddle wheel shaft within the second paddle wheel compartment, includes a second plurality of paddle wheel blades with distal tips, and rotates in response to fluid from the second flow path. A first radial clearance between a first internal surface of the first paddle wheel compartment and the distal tips of the first plurality of paddle wheel blades is different from a second radial clearance between a second internal surface of the second paddle wheel compartment and the distal tips of the second plurality of paddle wheel blades.

DETAILED DESCRIPTION

Figure 1B:
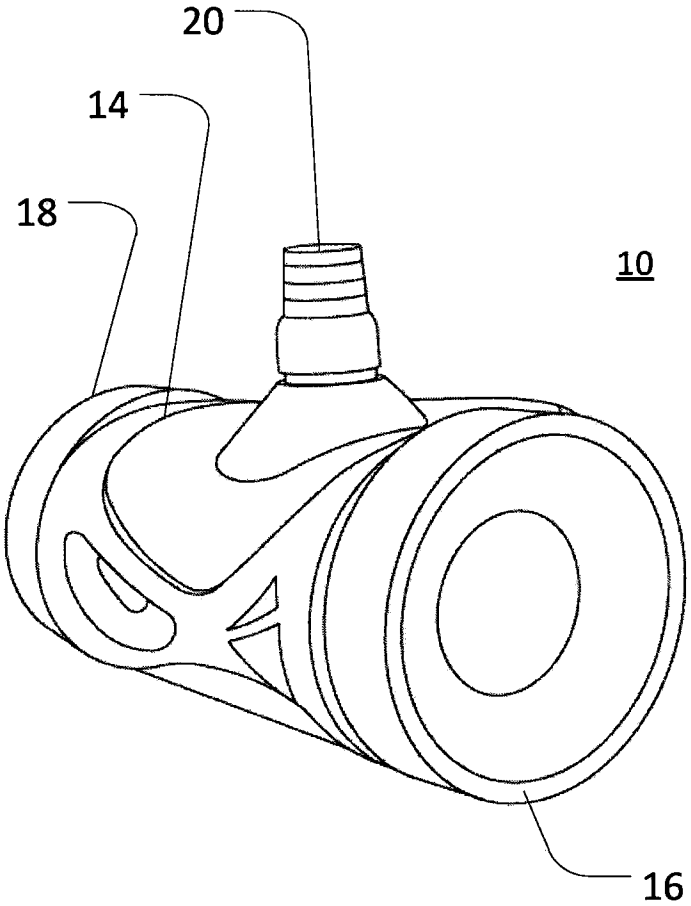
FIGS. 1A and 1B are isometric views of a pool cleaner for use with a paddle wheel mechanism described herein.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings. It will be understood that terms such as "upper," "lower," "top," "bottom," and the like may be used with respect to an orientation depicted in a particular figure and are not intended to limit the disclosure to a particular orientation.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Various types of suction-side (or other) swimming pool cleaners are operated using energy harvested from the flow of fluid drawn through them. More specifically, suction-side pool cleaners are connected to a suction side of a pool pump that causes fluid to be drawn along a fluid path within the pool cleaner. A paddle wheel mechanism positioned within the fluid path may accordingly be utilized to harvest energy from the fluid flow along the fluid path.

As noted above, it may be useful to provide a paddle wheel mechanism for a pool cleaner that balances concerns of efficiency with other performance considerations. For example, it may be useful to provide a paddle wheel mechanism that harnesses kinetic energy with relatively high efficiency from a fluid flow, while also preventing debris from excessively interfering with performance of the system. In certain embodiments, such a paddle wheel mechanism may include a housing that directs fluid from a fluid path of the pool cleaner into two distinct flow paths. A first of the fluid flow paths may include a strainer or other device associated with the flow path to remove debris, while a second of the fluid flow paths may be defined by an opening sized to receive a relatively large amount of debris. A single paddle wheel shaft may support a first paddle wheel disposed within the first flow path, and also may support a second paddle wheel disposed within the second flow path. The first paddle wheel may rotate in response to fluid flow along the first flow path, and the second paddle wheel may rotate in response to fluid flow along the second flow path, with both the first and the second paddle wheel thereby providing rotational power to the paddle wheel shaft. The first paddle wheel may be configured to operate with relatively high efficiency within a relatively debris-free first fluid path, while the second paddle wheel may be configured to operate with relatively high performance in the second fluid path that is designed to accommodate a substantial amount of debris.

In certain embodiments, the first paddle wheel may include a first plurality of blades with a different configuration than a second plurality of blades included on the second paddle wheel. For example, the first plurality of blades may include a greater (or lesser) number blades or exhibit a different geometry than the second plurality of blades. In certain embodiments, a clearance between a portion of the first plurality of blades and the housing may be different from a clearance between a portion the second plurality of blades and the housing. For example, the radial clearance between distal tips of the first plurality of blades and the housing may be smaller than the radial clearance between distal tips of the second plurality of blades and the housing. This sizing may allow the first plurality of blades to harness kinetic energy with relatively high efficiency, while also allowing debris to pass between the second plurality of blades and the housing in order to ensure a high level of system performance.

Figure 1A:
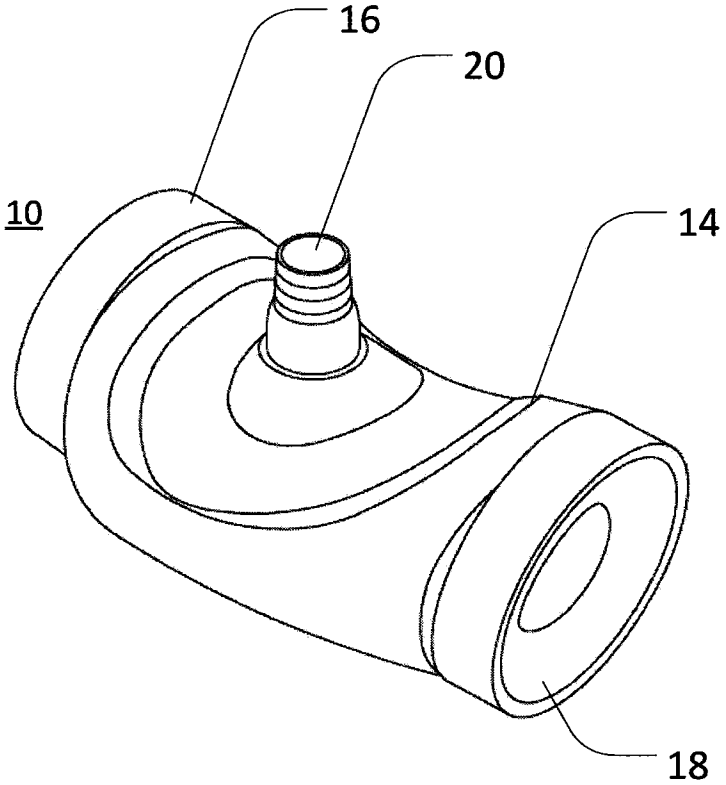

Referring now to FIG. 1, an example pool cleaner 10 is depicted, which may utilize a paddle wheel mechanism 12 (see, e.g., FIG. 2) to harvest kinetic energy of fluid moving through the pool cleaner 10. The pool cleaner 10 may be configured as a suction-side pool cleaner, or as various other types of pool cleaners (e.g., a pressure-side pool cleaner) known in the art. The pool cleaner 10 generally includes a housing 14, which is designed to retain the paddle wheel mechanism 12, and opposing wheels 16, 18 associated with the housing 14. The pool cleaner 10 further includes in an inlet (not shown) disposed on a lower surface of the pool cleaner 10 that allows for fluid and/or debris to enter into and/or travel through the pool cleaner 10. The pool cleaner 10 also includes an outlet 20 provided in the form of a cylindrical connection extending from an upper portion of the housing 14, which is designed to interact with a hose (not shown) that transports debris and/or water to a pool filtering mechanism and/or collection device. In certain embodiments, rotation of the paddle wheel mechanism 12 may provide kinetic energy for driving wheels 16 and 18, and/or for various other features or components (e.g., vacuuming).

Figure 2:
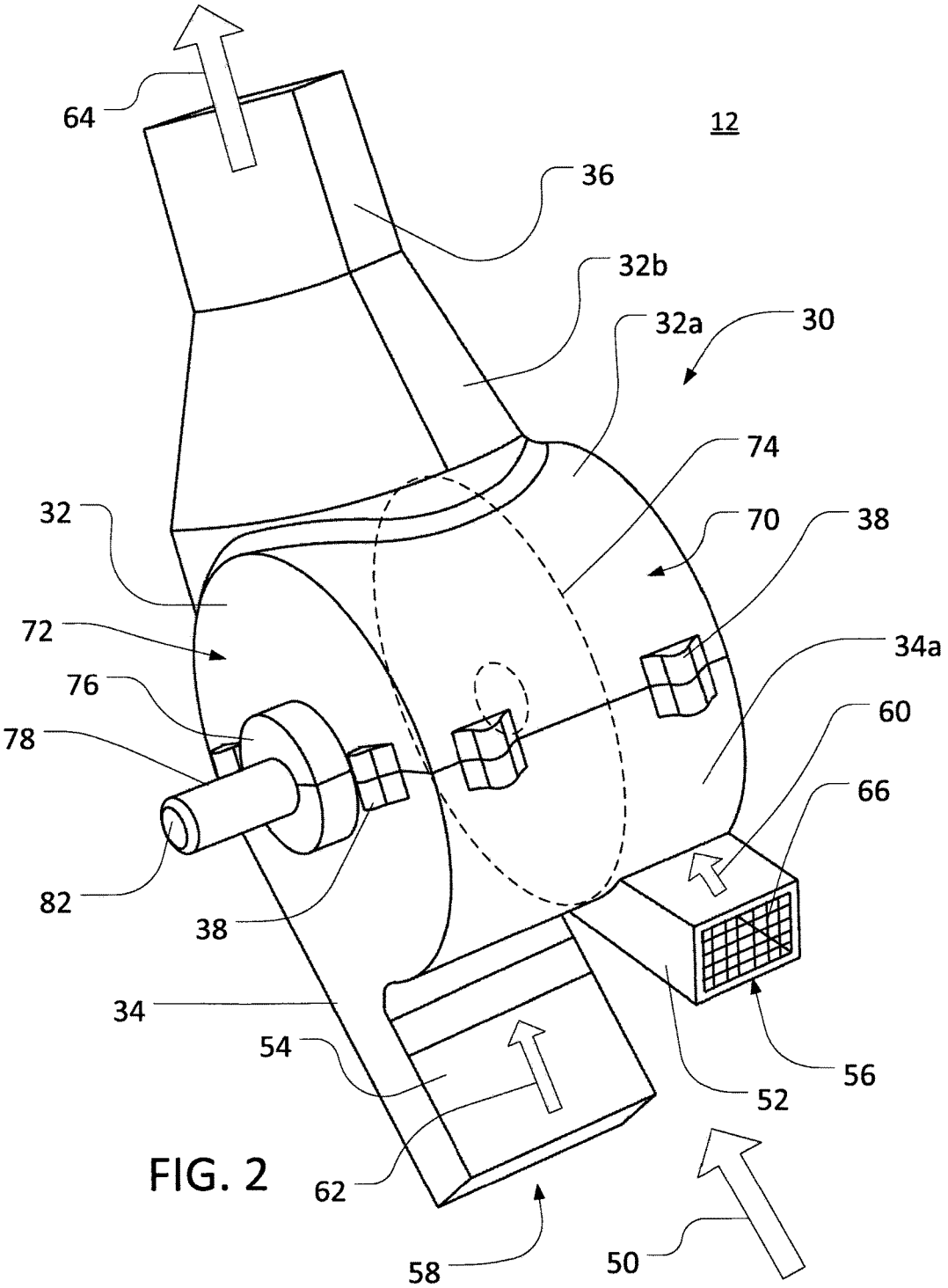
FIG. 2 is an isometric view of a paddle wheel mechanism including a housing.
Figure 3:
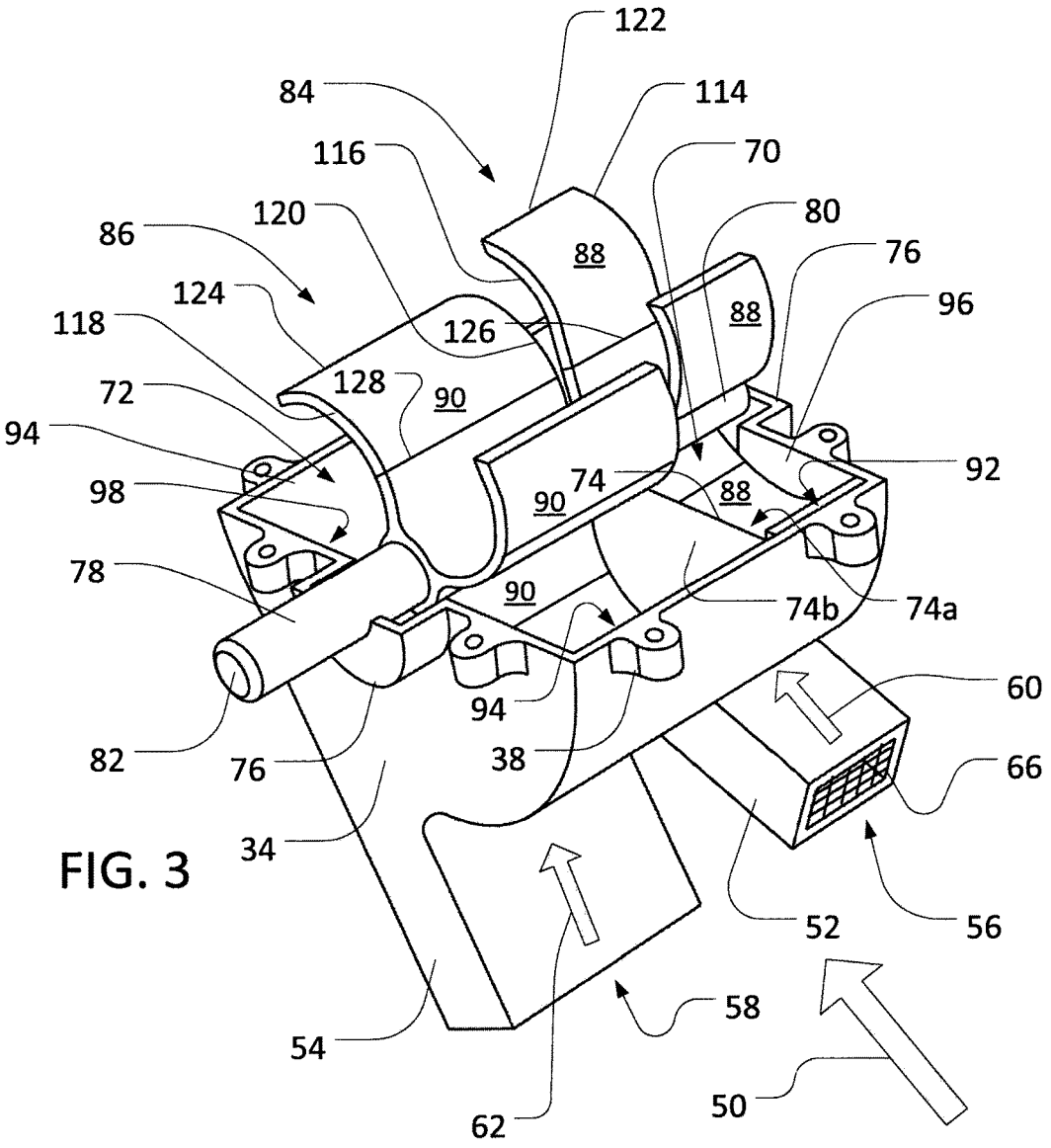
FIG. 3 is an isometric view of the paddle wheel mechanism of FIG. 2 with an upper portion of the housing removed to show a paddle wheel shaft, a first paddle wheel, and a second paddle wheel.
Figure 4:
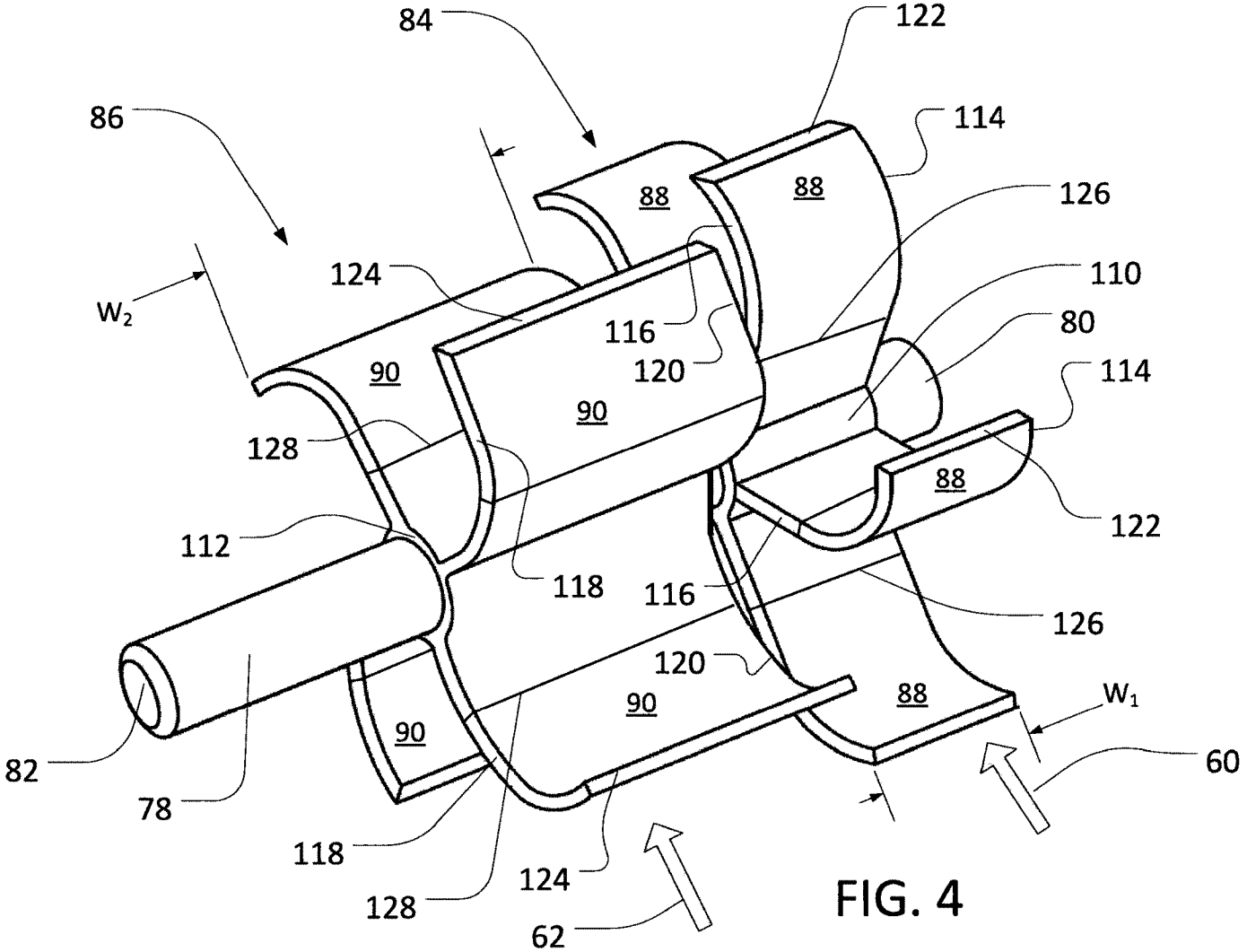
FIG. 4 is an isometric view of the paddle wheel shaft, and the first and second paddle wheels of FIG. 3 removed from the housing for clarity.

Referring to FIGS. 2-4, the paddle wheel mechanism 12 is depicted, which is designed for handling debris and harvesting energy within the swimming pool cleaner 10. Referring in particular to FIG. 2, the paddle wheel mechanism 12 generally includes a paddle wheel housing 30, and a paddle wheel assembly defined by a first paddle wheel 84 and a second paddle wheel 86. The paddle wheel housing 30 is defined by an upper housing portion 32 and a lower housing portion 34. The housing 30 is configured to be disposed inside of the pool cleaner housing 14 and to be disposed within a fluid path 50 of the pool cleaner 10. In one embodiment, the paddle wheel mechanism 12 is sized to fit within the housing 14 of the pool cleaner 10. In another embodiment, some portions of the housing 30 of the paddle wheel mechanism 12 are integral with portions of the housing 14 of the pool cleaner 10. In a further embodiment, portions of the housing 30 may be omitted. As depicted, the upper housing portion 32 is secured to the lower housing portion 34 by one or more screw-mount bodies 38, although various other attachment mechanisms may be utilized, including hinges, clasps, latches and the like. The upper housing portion 32 and lower housing portion 34 may be releasably joined to each other to provide access to internal components of the paddle wheel mechanism 12 during, for example, cleaning or maintenance. As shown in FIGS. 2 and 3, the housing 30 includes shaft supports 76 on opposing sides thereof, each of which supports ends of a single paddle wheel shaft 78, described in more detail below.

The upper housing portion 32 is defined by a substantially semi-circular lower section 32*a* that is integral with a conical member 32*b* that terminates at a cylindrical outlet portion 36. The conical member 32*b* is sized in a substantially similar manner to the lower section 32*a* adjacent thereto and continuously tapers inwardly until joining the cylindrical outlet portion 36. The conical member 32*b* is designed to accommodate a larger volume of fluid and/or debris than the cylindrical outlet portion 36. The cylindrical outlet portion 36 defines a substantially circular opening that is in communication with the outlet 20 of the pool cleaner 10. The upper housing portion 32 defines an exit flow path for fluid and/or debris that is traveling through the housing 30 to the outlet 20.

The lower housing portion 34 is defined by a substantially semi-circular base 34*a* that includes a first inlet 52 and a second inlet 54 extending therefrom. The lower section 32*a* of the upper housing portion 32 and the base 34*a* of the lower housing portion 34 collectively define a compartment to hold the first and second paddle wheels 84, 86. The first inlet 52 is configured as an extended rectilinear duct defining a first inlet opening 56 and a first cross-sectional flow area. The second inlet 54 is configured as an extended rectilinear duct providing a second inlet opening 58 and a second, larger cross-sectional flow area, as compared to the first cross-sectional flow area of the first inlet 52. The first inlet 52 is generally configured to accept fluid, whereas the second inlet 54 is generally configured to accept debris and a portion of fluid. More specifically, fluid may enter both the first inlet 52 and the second inlet 54, but the second inlet 54 is designed to accept relatively large amounts of debris, including debris sized larger than the first cross-sectional flow area of the first inlet 52.

The first inlet 52 and the second inlet 54 protrude outwardly from the semi-circular base 34*a* of the lower housing portion 34 at substantially different orientations. In the embodiment depicted, the second inlet 54 protrudes outwardly from the semi-circular base 34*a* of the lower housing portion 34 along a direction that is substantially parallel to the cylindrical outlet portion 36 (e.g., along the same axis). The first inlet 52 protrudes outwardly from the semi-circular base 34*a* along a direction that is different from the orientation of the second inlet 54. In one embodiment, the first inlet 52 protrudes outwardly at an angle that is offset, or deviates by about 30 degrees from the direction of the second outlet 54. It will be understood that other configurations may be possible, including configurations in which the second inlet 54 protrudes in a direction that is not substantially parallel with the cylindrical outlet portion 36, configurations in which the first inlet 52 protrudes in a direction that deviates by greater or less than 30 degrees from the direction of the second outlet 54, and configurations in which the first inlet 52 and the second inlet 54 extend outwardly in approximately parallel directions with respect to each other.

In certain embodiments, a strainer 66 provided in the form of a filter, a mesh, or another device configured to block the passage of debris, may be associated with the first inlet 52. As depicted, the strainer 66 is mounted at an end of the first inlet 52 to substantially cover the first inlet opening 56, which may be useful to allow for periodic cleaning or replacement of the strainer 66. In certain embodiments, however, the strainer 66 may be provided at one or more different locations within the first inlet 52. In other embodiments, a strainer 66 may not be employed and the inlet opening 56 may be otherwise protected or constrained to limit the passage of debris therein.

The size of the inlet opening 56 in conjunction with the strainer 66 limit the amount and size of debris that is capable of entering the first inlet 52. More particularly, the strainer 66 and/or sizing of the inlet opening 56 are designed to provide a relatively debris-free stream of fluid across the first paddle wheel 84. For example, the inlet opening 56 may be configured to be small enough that debris of a particular size cannot pass through the inlet opening 56, or the inlet opening 56 may be oriented to receive fluid from a compartment or cavity (not shown) that is protected from debris.

The first inlet 54 and the second inlet 56 are designed to receive a portion of fluid and/or debris defined by the fluid flow path 50. More specifically, the housing 30 may direct fluid from the fluid path 50, via the first and second inlets 54 and 56, into a first flow path 60 and a second flow path 62 within the housing 30. The flow paths 60 and 62 may pass separately through various portions of the housing 30 (as discussed in greater detail below), and may recombine into a single outlet flow path 64 through the outlet portion 36.

Referring to FIG. 3, the housing 30 further defines a first paddle wheel compartment 70 and a second paddle wheel compartment 72 designed to hold the first paddle wheel 84 and the second paddle wheel 86, respectively. The two compartments 70 and 72 extend into and between the lower housing portion 34 and the upper housing portion 32 (see, e.g., FIG. 2), and are separated by an internal divider 74. The internal divider 74 may be configured as a plate (or plates) bounding the first paddle wheel compartment 70 at a surface 74*a* and bounding the second paddle wheel compartment 72 at an opposing surface 74*b*. By separating the two paddle wheel compartments 70 and 72, the internal divider 74 also serves to separate the first flow path 60 from the second flow path 62 within the housing 30.

The first paddle wheel compartment 70 of the housing 30 is defined, at least in part, by a curved interior surface 92, which may be designed to generally provide relatively small clearances for rotation of the first paddle wheel 84. For example, the interior surface 92 may be generally curved to follow the path traced by the radially outermost portions of the first paddle wheel 84, as discussed in greater detail below, with the interior surface 92 generally defining a relatively small clearance between outermost portions of the first paddle wheel 84 and the interior surface 92. The first paddle wheel compartment 70 is also defined by an internal surface 96 (e.g., a side wall) and the surface 74*a* of the divider 74, each of which may be designed to provide relatively small clearances for lateral features of the first paddle wheel 84.

Similarly, the second paddle wheel compartment 72 of the housing 30 is defined, at least in part, by a curved interior surface 94, which may be designed to generally provide relatively small clearances for rotation of the second paddle wheel 86. For example, the interior surface 94 may be generally curved to follow the path traced by the radially outermost (or other) portions of the paddle wheel 86, as discussed in greater detail below, with the interior surface 94 generally defining a clearance between the outermost portions of the second paddle wheel 86 and the surface 94. The second paddle wheel compartment 72 is also defined by internal surface 98 (e.g., a side wall) and the surface 74*b* of the divider 74, each of which may be designed to provide relatively small clearances for lateral features of the paddle wheel 86.

The first and second paddle wheel compartments 70, 72 are designed to receive the first and second paddle wheels 84 and 86, respectively, which are supported by a paddle wheel shaft 78. The paddle wheel shaft 78 is depicted as a single cylindrical shaft that extends through the first and second paddle wheels 84, 86 and interacts with the shaft supports 76, which allows the paddle wheel shaft 78 to turn freely within the housing 30. In the embodiment depicted, an interior end 80 of the paddle wheel shaft 78 is fully enclosed by the housing 30 and an exterior end 82 of the paddle wheel shaft 78 extends outside of the housing 30. In this way, through connection of various devices or mechanisms to the exterior end 82 of the shaft 78, rotation of the paddle wheel shaft 78 may be utilized to provide power to a drive mechanism or steering mechanism (not shown) of the pool cleaner 10. It will be understood that, in other embodiments, the paddle wheel shaft 78 may be mounted within the housing 30 for rotation in a variety of other known ways. For example, the shaft supports 76 may support one or more bearings (not shown), which in turn support the paddle wheel shaft 78, or the end 82 of the paddle wheel shaft 78 may not extend outside of the housing 30. Similarly, the paddle wheel shaft 78 may be a single-body shaft, may include two co-axial half-shafts, or may take a variety of other configurations. Further, in certain embodiments, the interior end 80 of the paddle wheel shaft 78 may also extend outside of the housing 30.

As shown in FIGS. 3 and 4, the paddle wheel shaft 78 supports both the first paddle wheel 84 and the second paddle wheel 86, with the first paddle wheel 84 rotating within the first paddle wheel compartment 70 and the second paddle wheel 86 rotating within the second paddle wheel compartment 72. The first paddle wheel 84 includes a plurality of blades 88 that extend radially away from a base 110 and are mounted to (or integrally formed with) the paddle wheel shaft 78. The blades 88 are each defined by a curved member that is bounded by an exterior lateral edge 114, an interior lateral edge 116, and a distal tip 122. Likewise, the second paddle wheel 86 includes a plurality of blades 90 that extend radially away from a base 112 and are mounted to (or integrally formed with) the paddle wheel shaft 78. The blades 90 are each defined by a curved member that is bounded by an exterior lateral edge 118, an interior lateral edge 120, and a distal tip 124. In certain embodiments, the bases 110 and 112 are non-rotatably attached to the paddle wheel shaft 78, such that the rotation of each of paddle wheels 84 and 86 provides rotational power to the paddle wheel shaft 78.

In the embodiment depicted, the paddle wheel blades 88 and 90 include a generally curved profile over the majority of their extension away from the paddle wheel shaft 78, in order to effectively harvest kinetic energy from passing fluid. It will be understood, however, that other configurations are possible, including those in which the blades 88 and/or 90 have straight profiles. As depicted in FIG. 4, a width dimension $W_1$ of the first paddle wheel blades 88 may be generally smaller than a width dimension $W_2$ of the second paddle wheel blades 90. It will be understood, however, that other configurations are possible, including those in which the first-blade width dimension $W_1$ is equal to or greater than the second-blade width dimension $W_2$ In the embodiment depicted, the first paddle wheel 84 includes six blades 88 (some of which are hidden from view in the various figures), and the second paddle wheel 86 includes four blades 90. It will be understood, however, that in other embodiments the first paddle wheel 84 may include the same number of blades as the second paddle wheel 86 (e.g., in a configuration with six blades 88 and six blades 90, or with four blades 88 and four blades 90) or may include fewer blades than the second paddle wheel 86 (e.g., in a configuration with four blades 88 and six blades 90).

Portions of the blades 88 and 90 may be separable, respectively, from the paddle wheel bases 110 and 112 at, respectively, joints 126 and 128. This may be useful, for example, in order to allow for relatively easy cleaning or maintenance of the first and second paddle wheels 84, 86, as well as to allow for customizability of the paddle wheels 84 and 86. For example, if a particular radial clearance is desired for blades 88 and a different radial clearance is desired for blades 90, a particular set of blades 88 may be selected and attached to the base 110 at the joint 126, and a particular set of blades 90 may be selected and attached to the base 112 at the joint 128. Similarly, the number of the blades 88 and 90, or various other aspects of the paddle wheels 84 and 86 may be similarly varied through selective attachment of particular blades 88 and 90 at, respectively, the joints 126 and 128.

As noted above, various internal surfaces of the first and second paddle wheel compartments 70, 72 provide particular clearances with respect to various features of the first and second paddle wheels 84, 86. For example, the surfaces 96 and 74*a* within the first paddle wheel compartment 70 may provide a relatively small clearance, respectively, for the exterior lateral edges 114 and the interior lateral edges 116 of the paddle wheel blades 88 of the first paddle wheel 84. Similarly, the surfaces 98 and 74*b* within the second paddle wheel compartment 72 may provide a relatively small clearance, respectively, for the exterior lateral edges 118 and the interior lateral edges 120 of paddle wheel blades 90 of the second paddle wheel 86.

In certain embodiments, different clearances may be provided for various features of the blades 88 of the first paddle wheel 84 than for various features of the blades 90 of the second paddle wheel 86. For example, a radial clearance between one or more distal tips 122 of the blades 88 and the interior surface 92 of the first paddle wheel compartment 70 may be somewhat smaller than a radial clearance between one or more distal tips 124 of the blades 90 and the interior surface 94 of the second paddle wheel compartment 72. Among other benefits, a larger gap may be provided between the blades 90 and the housing 30 for easier passage of debris past the second paddle wheel 86 and through the second paddle wheel compartment 72. This configuration may be useful, for example, in order to allow debris to be gathered by the pool cleaner 10 in a cleaning operation. As such, a particular radial clearance (or clearances) for the blades 90 may be selected based upon the type and size of debris expected to pass through the housing 30.

Figure 5:
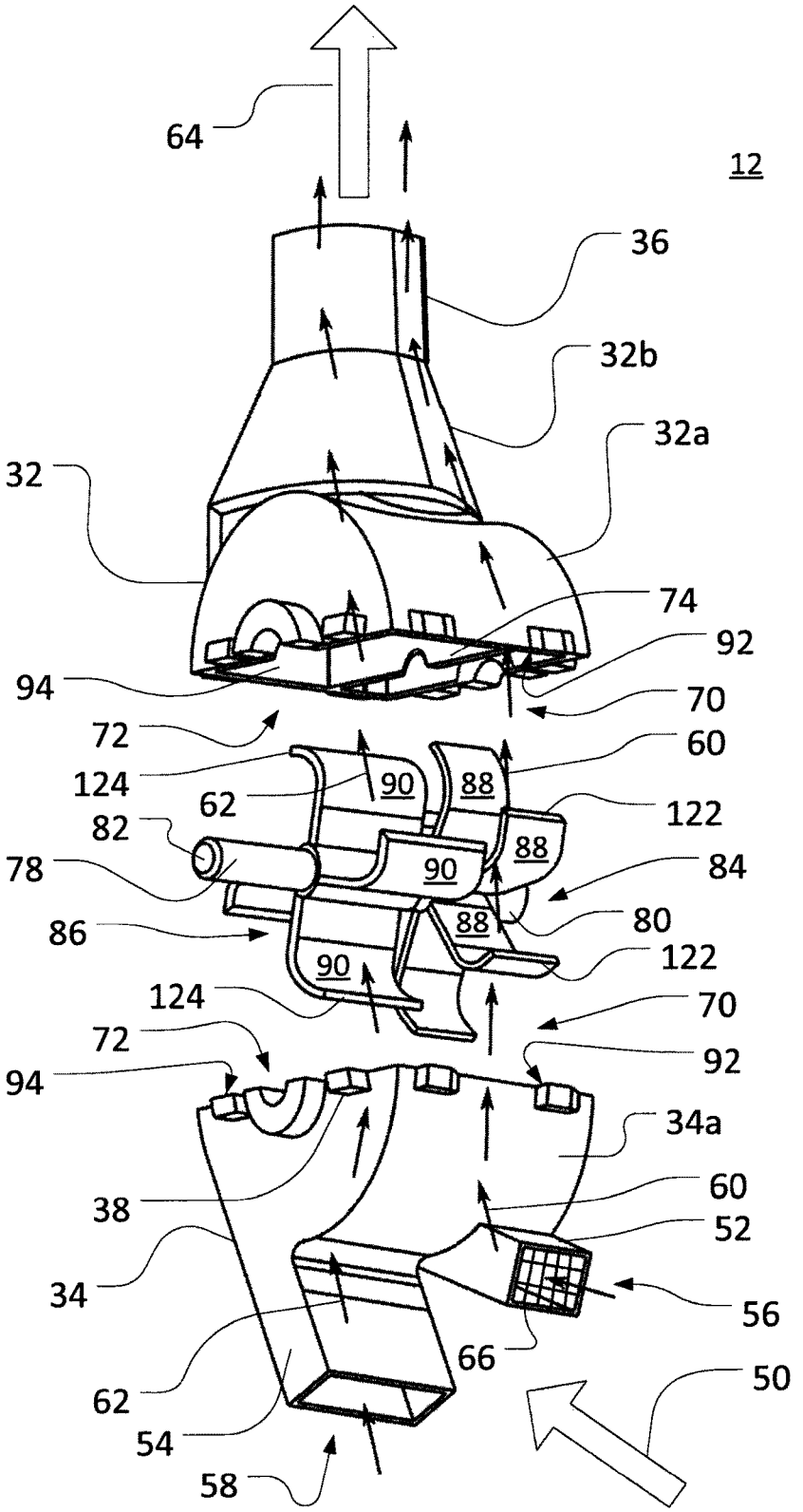
FIG. 5 is an exploded view of the paddle wheel mechanism of FIG. 2 depicting example fluid flow paths through the housing.

Referring now to FIG. 5, various aspects of the operation of the paddle wheel mechanism 12 are depicted. Fluid flowing along the fluid path 50 is directed by the housing 30 into the first and second flow paths 60, 62. A portion of the fluid from fluid flow path 50 is split into the first flow path 60 and passes through the first inlet opening 56 and the strainer 66 such that debris is removed from the first flow path 60 before reaching the first paddle wheel compartment 70. As a result, fluid flowing along the first flow path 60 across the first paddle wheel 84 within the first compartment 70 may be relatively debris-free. Accordingly, relatively small clearances may be provided between the paddle wheel blades 88 and the interior surfaces of the first paddle wheel compartment 70 (i.e., because there is little to no debris flowing along the first flow path 60) and the first paddle wheel 84 may operate with relatively high efficiency. For example, the paddle wheel blades 88 may be configured such that the distal tips 122 of the blades 88 pass very closely along, or adjacent to, the interior surface 92 of the housing 30. Accordingly, when the fluid moving along the first flow path 60 causes the first paddle wheel 84 to rotate, the first paddle wheel 84 harvests a relatively high proportion of the kinetic energy of the fluid. In certain embodiments, a large number of blades 88 (e.g., six of the blades 88) may be provided in order to efficiently harvest the kinetic energy of the flow path 60.

A portion of the fluid from fluid flow path 50 is split into the second flow path 62 and passes through the second inlet opening 58 to reach the second paddle wheel compartment 72. In contrast with the first flow path 60, fluid flowing along the second flow path 62 may not travel through a strainer or other similar mechanism, so fluid flowing along the second flow path 62 and through the second paddle wheel compartment 72 may include a relatively large amount of debris. Passage of debris through the housing 30 via the second flow path 62 may facilitate various cleaning operations by the pool cleaner 10, and, as noted above, a relatively large flow area may be provided along the second flow path 62 to accommodate the debris. To allow the debris-laden flow to pass across the second paddle wheel 86, however, without excessively detrimental effect on system performance, relatively large clearances may be provided between the paddle wheel blades 90 of the second paddle wheel 86 and the interior surfaces of the second paddle wheel compartment 72. For example, the paddle wheel blades 90 may be configured such that the distal tips 124 of the blades 90 trace a path that is substantially spaced from, or removed from, the interior surface 94 of housing 30. Accordingly, when the fluid moving along the second flow path 62 causes the second paddle wheel 86 to rotate, debris traveling along the second flow path 62 may pass between the distal tips 124 and the interior surface 94 of the housing 30 without excessively impeding the rotation of the second paddle wheel 86. In certain embodiments, a small number of the blades 90 (e.g., four of the blades 90) may be provided, in order to further prevent the debris in the second flow path 62 from adversely affecting rotation of the second paddle wheel 86.

Accordingly, in various configurations, the first paddle wheel 84 may be designed to provide a high level of efficiency and the second paddle wheel 86 may be designed to provide a high level of performance, even in a debris-laden flow. As such, the first paddle wheel 84 may serve as a primary power source for pool cleaner operation, and the second paddle wheel 86 may allow debris to pass through the housing 30 while also providing a secondary source of additional power. Both of the first and second paddle wheels 84, 86 may together provide rotational power to other components of the pool cleaner 10 due to rotation on a common shaft 78. Further, either of the first or second paddle wheels 84, 86 may assist the rotation of the other, as needed. For example, in the event that rotation of the second paddle wheel 86 is hindered by accumulating debris, the high efficiency rotation of the first paddle wheel 84 may provide additional power to rotate the second paddle wheel 86 in order to dislodge the accumulated debris and return the second paddle wheel 86 to a higher performance operation.

It will be understood that certain embodiments may differ from the example configurations noted above. For example, in certain embodiments, the lower housing portion 34 may include a single inlet opening (not shown), with various internal features of the lower housing portion 34 directing fluid from single inlet into the first and second flow paths 60 and 62. Similarly, in certain embodiments, the upper housing portion 34 may include two outlet openings (not shown), with a first of the outlet openings providing an outlet for fluid from the first flow path 60 and a second of the outlet openings providing an outlet for fluid from the second flow path 62.

In certain embodiments, one or both of the first and second inlets 52, 54 may include non-rectangular geometry, including circular, ovular, or other cross-sectional geometry. Likewise, one or both of the first and second inlets 52, 54 may include constant (e.g., FIG. 2) or variable cross-sectional geometry. In certain embodiments, the flow area of the first inlet 52 may be equal to the flow area of the second inlet 54, or the flow area of the first inlet 52 may be larger than the flow area of the second inlet 54.

In additional embodiments, two separate housings (not shown) may be provided. For example, a first of two housings may enclose the first paddle wheel 84, a second of the two housings may enclose the second paddle wheel 86, and a common shaft 78 for both paddle wheels 84 and 86 may extend between the two housings.

In some embodiments, the blades 88 of the first paddle wheel 84 may extend a similar radial distance away from the paddle wheel shaft 78 (or the paddle wheel base 110) as the blades 90 of the second paddle wheel 86 extend away from the paddle wheel shaft 78 (or the paddle wheel base 112), but a different radial clearance may still be provided between internal surfaces of the housing 30 and, respectively, the distal tips 122 and 124 of the blades 88 and 90. For example, a wall of the housing 30 that includes the interior surface 92 may be thicker than a wall of the housing 30 that includes the interior surface 94. Accordingly, the interior surface 92 may be generally closer to the paddle wheel shaft 78 than is the interior surface 94, such that a smaller radial clearance is provided for the blades 88 of the first paddle wheel 84 than for the blades 90 of the second paddle wheel 86 even though the blades 88 and 90 may extend the same radial distance away from the shaft 78.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

We claim:

1. A paddle wheel mechanism for a pool cleaner, the paddle wheel mechanism comprising: a housing including an upper housing coupled to a lower housing, wherein the upper housing includes a fluid outlet and the lower housing includes a first inlet and a second inlet, the housing positioned within a fluid path of the pool cleaner, the housing directing fluid from the fluid path into a first flow path from the first inlet to the outlet and a second flow path from the second inlet to the outlet, the first flow path being separated from the second flow path, at least in part, by the housing; a paddle wheel shaft supported by the housing; a first paddle wheel supported by the paddle wheel shaft and positioned within the housing along the first flow path, the first paddle wheel rotating responsive to fluid directed across the first paddle wheel by the first flow path; a second paddle wheel supported by the paddle wheel shaft and positioned within the housing along the second flow path, the second paddle wheel rotating responsive to fluid directed across the second paddle wheel by the second flow path; wherein the first paddle wheel includes a first plurality of paddle wheel blades and the second paddle wheel includes a second plurality of paddle wheel blades; wherein the first plurality of paddle wheel blades define a first radial clearance between one or more distal tips of the first plurality of paddle wheel blades and a first interior surface of the housing, and the second plurality of paddle wheel blades define a second radial clearance between one or more distal tips of the second plurality of paddle wheel blades and a second interior surface of the housing, the second radial clearance being larger than the first radial clearance; and a first blade width for the first plurality of paddle wheel blades is smaller than a second blade width for the second plurality of paddle wheel blades.

2. The paddle wheel mechanism of claim 1, wherein the first plurality of paddle wheel blades and the second plurality of paddle wheel blades each include one or more curved paddle wheel blades.

3. The paddle wheel mechanism of claim 1, wherein the first plurality of paddle wheel blades includes six paddle wheel blades and the second plurality of paddle wheel blades includes four paddle wheel blades.

4. The paddle wheel mechanism of claim 1, further comprising a strainer positioned within the first flow path.

5. The paddle wheel mechanism of claim 1, wherein the second flow path provides a larger cross-sectional flow area than the first flow path.

6. The pool cleaner of claim 1, wherein the first paddle wheel rotates the paddle wheel shaft responsive to fluid directed across the first paddle wheel and the second paddle wheel rotates the paddle wheel shaft responsive to fluid directed across the second paddle wheel; wherein the rotating paddle wheel shaft is configured to provide power to one or more components of the pool cleaner.

7. A pool cleaner comprising: a housing positioned within a fluid path of the pool cleaner, the housing splitting fluid from the fluid path into one of a first flow path, and a second flow path, the first flow path being separated from the second flow path, at least in part, by the housing; a paddle wheel shaft supported by the housing; a first paddle wheel supported by the paddle wheel shaft and positioned within the housing along the first flow path, the first paddle wheel rotating responsive to fluid directed across the first paddle wheel by the first flow path; and a second paddle wheel having a different geometry than the first paddle wheel, the second paddle wheel being supported by the paddle wheel shaft and positioned within the housing along the second flow path, the second paddle wheel rotating responsive to fluid directed across the second paddle wheel by the second flow path; wherein the first paddle wheel includes a first plurality of paddle wheel blades and the second paddle wheel includes a second plurality of paddle wheel blades; wherein the first plurality of paddle wheel blades define a first radial clearance between one or more distal tips of the first plurality of paddle wheel blades and a first interior surface of the housing, and the second plurality of paddle wheel blades define a second radial clearance between one or more distal tips of the second plurality of paddle wheel blades and a second interior surface of the housing, the second radial clearance being larger than the first radial clearance; and a first blade width for the first plurality of paddle wheel blades is smaller than a second blade width for the second plurality of paddle wheel blades.

8. The pool cleaner of claim 7, wherein the second plurality of paddle wheel blades have a different geometry with respect to the first plurality of paddle wheel blades.

9. The pool cleaner of claim 8, wherein each of the first plurality of paddle wheel blades are defined by a width dimension that is smaller than a width dimension of each of the second plurality of paddle wheel blades.

10. The pool cleaner of claim 7 further including a strainer is associated with the first flow path.

11. The pool cleaner of claim 7, wherein the second flow path provides a larger cross-sectional flow area than the first flow path.

12. The pool cleaner of claim 7 further comprising a first inlet to the housing directing fluid from the fluid path along the first flow path and a second inlet directing fluid from the fluid path along the second flow path.

13. The pool cleaner of claim 12, wherein the first inlet is offset with respect to the second inlet.

14. The pool cleaner of claim 13, wherein the housing further includes an outlet portion.

15. The pool cleaner of claim 14, wherein the second inlet is substantially aligned with the outlet portion.

16. The pool cleaner of claim 7, wherein the pool cleaner further comprises at least two wheels positioned on opposing sides of the pool cleaner and an outlet.

17. A paddle wheel mechanism for a pool cleaner, the paddle wheel mechanism comprising: a housing positioned within a fluid path of the pool cleaner, the housing including an outlet, a first paddle wheel compartment and a second paddle wheel compartment, the first paddle wheel compartment being separated from the second paddle wheel compartment, at least in part, by an internal surface of housing, the housing directing fluid from the fluid path into a first flow path through the first paddle wheel compartment and a second flow path through the second paddle wheel compartment, the first flow path and the second flow path passing separately through the housing and recombining before the outlet; a paddle wheel shaft supported by the housing; a first paddle wheel positioned within the first paddle wheel compartment and supported by the paddle wheel shaft, the first paddle wheel including a first plurality of paddle wheel blades and rotating responsive to fluid directed by the first flow path across the first plurality of paddle wheel blades; and a second paddle wheel positioned within the second paddle wheel compartment and supported by the paddle wheel shaft, the second paddle wheel including a second plurality of paddle wheel blades and rotating responsive to fluid directed by the second flow path across the second plurality of paddle wheel blades; wherein the first plurality of paddle wheel blades define a first radial clearance between one or more distal tips of the first plurality of paddle wheel blades and a first interior surface of the first paddle wheel chamber, and the second plurality of paddle wheel blades define a second radial clearance between one or more distal tips of the second plurality of paddle wheel blades and a second interior surface of the second paddle wheel chamber, the second radial clearance being larger than the first radial clearance; and a first blade width for the first plurality of paddle wheel blades is smaller than a second blade width for the second plurality of paddle wheel blades.

* * * * *